US010699637B2

(12) United States Patent
Hyun et al.

(10) Patent No.: US 10,699,637 B2
(45) Date of Patent: Jun. 30, 2020

(54) PIXEL AND DISPLAY DEVICE INCLUDING THE SAME

(71) Applicant: Samsung Display Co., Ltd., Yongin-si, Gyeonggi-Do (KR)

(72) Inventors: Chae Han Hyun, Yongin-si (KR); Seung Kyu Lee, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 22 days.

(21) Appl. No.: 16/212,382

(22) Filed: Dec. 6, 2018

(65) Prior Publication Data

US 2019/0304365 A1 Oct. 3, 2019

(30) Foreign Application Priority Data

Mar. 29, 2018 (KR) ..... 10-2018-0036833

(51) Int. Cl.
*G09G 5/00* (2006.01)
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2320/0209* (2013.01); *G09G 2320/0219* (2013.01); *G09G 2320/0238* (2013.01)

(58) Field of Classification Search
CPC ..... G09G 3/3233
USPC ..... 345/214
See application file for complete search history.

(56) References Cited

U.S. PATENT DOCUMENTS

2011/0292019 A1* 12/2011 Yamamoto ..... G09G 3/3258 345/211
2012/0026145 A1* 2/2012 Jeong ..... G09G 3/3233 345/211
2013/0099692 A1* 4/2013 Chaji ..... G09G 3/3291 315/224
2013/0201172 A1* 8/2013 Jeong ..... G09G 3/3233 345/212
2014/0139502 A1* 5/2014 Han ..... G09G 3/3233 345/212
2014/0313232 A1* 10/2014 Han ..... G09G 3/3233 345/690
2016/0351124 A1* 12/2016 Kim ..... G09G 3/3291

* cited by examiner

*Primary Examiner* — Adam J Snyder
(74) *Attorney, Agent, or Firm* — Kile Park Reed & Houtteman PLLC

(57) ABSTRACT

A pixel includes: an organic light emitting diode; a first transistor for controlling an amount of driving current flowing from a first voltage line connected to a second node to a second voltage line via the organic light emitting diode, corresponding to a voltage of a first node; a second transistor connected between a data line and the second node, the second transistor having a gate electrode connected to a first scan line; a third transistor connected between the first voltage line and a third node, the third transistor having a turn-on period that does not overlap with that of the second transistor; a fourth transistor connected to the third node, the fourth transistor having a gate electrode connected to the first scan line; a first capacitor connected between the first voltage line and the first node; and a second capacitor connected between the data line and the third node.

18 Claims, 6 Drawing Sheets

PIXEL AND DISPLAY DEVICE INCLUDING THE SAME

CROSS-REFERENCE TO RELATED APPLICATION

Korean patent application 10-2018-0036833 filed on Mar. 29, 2018 in the Korean Intellectual Property Office, and entitled: "Pixel and Display Device Including the Same," is incorporated by reference herein in its entirety.

BACKGROUND

1. Field

The present disclosure generally relates to a pixel and a display device including the same.

2. Description of the Related Art

An organic light emitting display device includes an organic light emitting diode (OLED) of which luminance is controlled by a current or a voltage. The OLED includes a positive electrode layer and a negative electrode layer, which form an electric field, and an organic light emitting material that emits light by the electric field. The organic light emitting display device displays an image by controlling a plurality of pixels to emit light during a predetermined emission period in one frame.

SUMMARY

According to an aspect of the present disclosure, there is provided a pixel including: an organic light emitting diode; a first transistor to control an amount of driving current flowing from a first voltage line coupled to a second node to a second voltage line via the organic light emitting diode, corresponding to a voltage of a first node; a second transistor coupled between a data line and the second node, the second transistor having a gate electrode coupled to a first scan line; a third transistor coupled between the first voltage line and a third node, the third transistor having a turn-on period that does not overlap with that of the second transistor; a fourth transistor coupled to the third node, the fourth transistor having a gate electrode coupled to the first scan line; a first capacitor coupled between the first voltage line and the first node; and a second capacitor coupled between the data line and the third node.

The fourth transistor may be coupled between the third node and the data line, between the third node and the first voltage line, or between the third node and a fourth voltage line. The fourth voltage line may have a constant voltage within a predetermined range.

The pixel may further include: a fifth transistor coupled between a second electrode of the first transistor and the first node, the fifth transistor having a gate electrode coupled to the first scan line; a sixth transistor coupled between the first node and a third voltage line, the sixth transistor having a gate electrode coupled to a second scan line; and a seventh transistor coupled between an anode electrode of the organic light emitting diode and the third voltage line, the seventh transistor having a gate electrode coupled to the first scan line.

The pixel may further include: an eighth transistor coupled between the first voltage line and the second node, the eighth transistor having a gate electrode coupled to an emission control line; and a ninth transistor coupled between the anode electrode of the organic light emitting diode, the ninth transistor having a gate electrode coupled to the emission control line.

The first scan line may be an ith (i is a natural number) scan line, and the second scan line may be an (i-1)th scan line.

A gate electrode of the third transistor may be coupled to the emission control line.

At least one of the first transistor, the second transistor, the third transistor, and the fourth transistor may be a P channel MOS transistor.

According to another aspect of the present disclosure, there is provided a display device including: pixels coupled to scan lines, emission control lines, and data lines; a scan driver to supply scan signals to the pixels through the scan lines; an emission driver to supply emission control signals to the pixels through the emission control lines; and a data driver to supply data signals to the pixels through the data lines, wherein a pixel coupled to an ith (i is a natural number) emission control line, an ith scan line, and a jth (j is a natural number) among the pixels includes: an organic light emitting diode; a first transistor to control an amount of driving current flowing from a first voltage line coupled to a second node to a second voltage line via the organic light emitting diode, corresponding to a voltage of a first node; a second transistor coupled between the jth data line and the second node, the second transistor having a gate electrode coupled to the ith scan line; a third transistor coupled between the first voltage line and a third node, the third transistor having a gate electrode coupled to the ith emission control line; a fourth transistor coupled to the third node, the fourth transistor having a gate electrode coupled to the ith scan line; a first capacitor coupled between the first voltage line and the first node; and a second capacitor coupled between the data line and the third node.

A turn-on period of the second transistor may not overlap with that of the third transistor.

The fourth transistor may be coupled between the third node and the data line, between the third node and the first voltage line, or between the third node and a fourth voltage line. The fourth voltage line may have a constant voltage within a predetermined range.

The scan driver may sequentially supply the scan signals to the pixels.

The emission driver may sequentially supply the emission control signals to the pixels.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
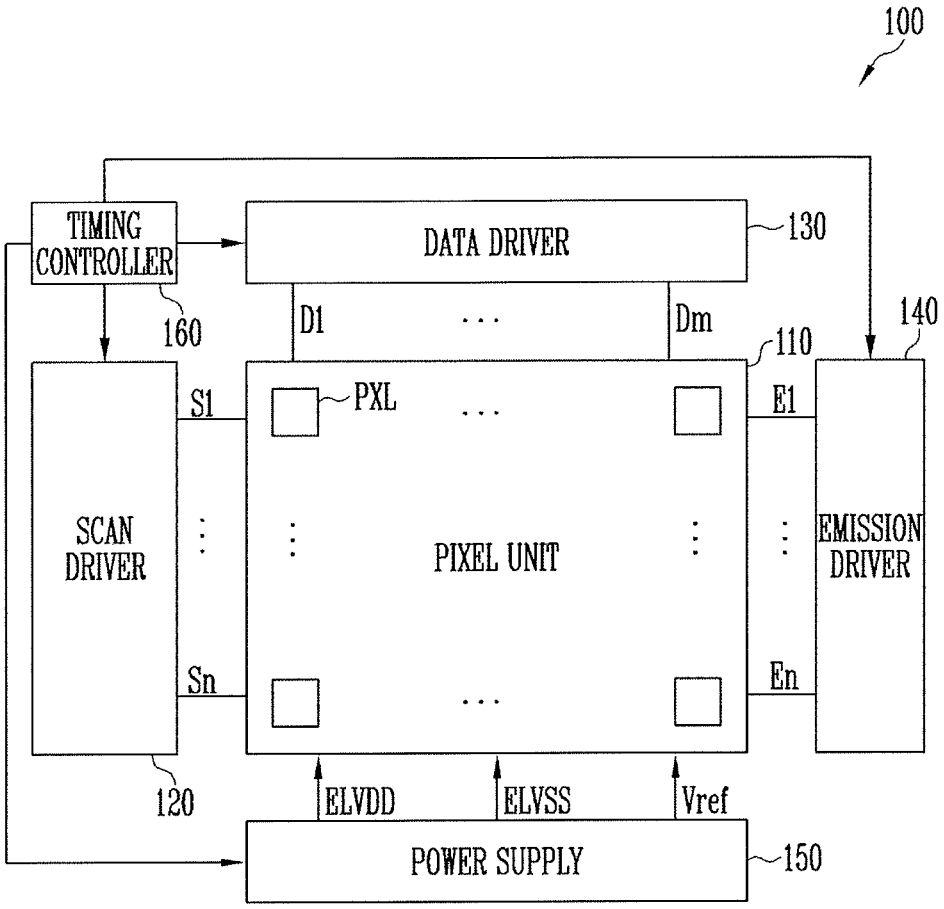
FIG. 1 illustrates a block diagram of a display device according to an embodiment of the present disclosure.

In the following detailed description, only certain exemplary embodiments of the present disclosure have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive.

Like numbers refer to like elements throughout, and duplicative descriptions thereof may not be provided. The thicknesses, ratios, and dimensions of elements may be exaggerated in the drawings for clarity. As used herein, the term "and/or" includes any and all combinations of one or more of the associated listed items.

It will be understood that, although the terms "first," "second," etc. may be used herein to describe one or more elements, these terms should not be construed as limiting such elements. These terms are only used to distinguish one element from another element. Thus, a first element could be alternately termed a second element without departing from the spirit and scope of the present disclosure. Similarly, a second element could be alternately termed a first element. Singular forms of terms are intended to include the plural forms as well, unless the context clearly indicates otherwise.

Moreover, spatially relative terms, such as "beneath," "below," "lower," "above," "upper," and the like may be used herein for ease of description to describe one element's spatial relationship to another element(s) as illustrated in the drawings. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be further understood that the terms "includes" and "including," when used in this disclosure, specify the presence of stated features, integers, acts, operations, elements, and/or components, but do not preclude the presence or addition of one or more other features, integers, steps, operations, elements, components, and/or groups thereof.

In the entire specification, when an element is referred to as being "connected" or "coupled" to another element, it can be directly connected or coupled to the another element or be indirectly connected or coupled to the another element with one or more intervening elements interposed therebetween. Further, some of the elements that are not essential to the complete understanding of the disclosure are omitted for clarity. Also, like reference numerals refer FIG. 1 is a diagram illustrating a display device 100 according to an embodiment of the present disclosure. Referring to FIG. 1, the display device 100 may include a pixel unit 110, a scan driver 120, a data driver 130, an emission driver 140, a power supply 150, and a timing controller 160. The scan driver 120, the data driver 130, the emission driver 140, the power supply 150, and the timing controller 160 are individually illustrated in FIG. 1. Alternatively, at least one or more of these components may be integrated. The scan driver 120, the data driver 130, the emission driver 140, the power supply 150, and the timing controller 160 may be installed in various ways including chip on glass, chip on plastic, tape carrier package, chip on film, and the like.

The pixel unit 110 may correspond to a display area of the display device 100. For example, the display device 100 may display an image through the display area. The pixel unit 110 may be coupled to scan lines S1 to Sn (n is a natural number). Therefore, the pixel unit 110 may receive scan signals from the scan driver 120 through the scan lines S1 to Sn. The pixel unit 110 may be coupled to the data lines D1 to Dm (m is a natural number). Therefore, the pixel unit 110 may receive data signals from the data driver 130 through the data lines D1 to Dm. The pixel unit 110 may be coupled to emission control lines E1 to En. Therefore, the pixel unit 110 may receive emission control signals from the emission driver 130 through the emission control lines E1 to En.

The pixel unit 110 may receive voltages from a first voltage line ELVDD, a second voltage line ELVSS, and a third voltage line Vref from the power supply 150. The pixel unit 110 may include pixels PXL. The pixels PXL may be arranged in a matrix. For example, the pixels PXL may be at intersections of the scan lines S1 to Sn and the data lines D1 to Dm or at intersections of the emission control lines E1 to En and the data lines D1 to Dm.

FIG. 1 illustrates n scan lines S1 to Sn and n emission control lines E1 to En. However, dummy scan lines or dummy emission control lines may be additionally formed so as to ensure stability of driving.

The pixels PXL may be coupled to the scan lines S1 to Sn, the emission control lines E1 to En, and the data lines D1 to Dm. The scan lines S1 to Sn and the emission control lines E1 to En may be formed for every pixel row, and the data lines D1 to Dm may be formed for every pixel column. The pixels PXL may receive scan signals through the scan lines S1 to Sn, receive emission control signals through the emission control lines E1 to En, and receive data signals through the data lines D1 to Dm.

Each of the pixels PXL may store a voltage corresponding to a data signal supplied thereto. The first voltage line ELVDD, the second voltage line ELVSS, and the third voltage line Vref may be supply voltages to the pixels PXL. Each of the pixels PXL may control an amount of driving current between the first voltage line ELVDD to the second voltage line ELVSS via an organic light emitting diode, based on the stored voltage. The organic light emitting diode may generate light with a luminance corresponding to the amount of driving current.

The pixels PXL may be driving in units of frames. The scan driver 120 may receive a scan driving control signal from the timing controller 160. For example, the scan driving control signal may include clock signals and a scan start signal. The scan start signal may control supply timings of scan signals, and the clock signals may be used to shift the scan start signal. The scan driver 120 may generate scan signals in response to the scan driving control signal. For example, the scan signals may have a gate-on voltage at which transistors included in the pixels PXL can be turned on.

The scan driver 120 may be coupled to the scan lines S1 to Sn. The scan driver 120 may supply scan signals to the scan lines S1 to Sn. For example, the scan driver 120 may sequentially the scan signals to the scan lines S1 to Sn. Alternatively, the scan driver 120 may supply two or more scan signals simultaneously to the scan lines S1 to Sn. Herein, when a scan signal is supplied, the scan signal has the gate-on voltage.

The data driver 130 may receive a data driving control signal and image data from the timing controller 160. For example, the data driving control signal may include a source start signal, a source output enable signal, a source sampling clock, and the like. The source start signal may control a data sampling start time of the data driver 130. The source sampling clock may control a sampling operation of the data driver 130, based a rising or falling edge. The source output enable signal may control an output timing of the data driver 130. The data driver 130 may generate data signals, based on a data driving control signal and the image data. For example, the data signals may have voltages within a predetermined range corresponding to the image data.

The data driver 130 may be coupled to the data lines D1 to Dm. The data driver 130 may supply data signals to the data lines D1 to Dm. For example, the data driver 130 may supply the data signals to the data lines D1 to Dm to be synchronized with the sequentially supplied scan signals. Herein, when a data signal is supplied, the data signal has a voltage within a predetermined range corresponding to the image data.

The emission driver 140 may receive an emission driving control signal from the timing controller 160. For example, the emission driving control signal may include clock signals and an emission start signal. The emission start signal may control supply timings of emission control signals, and the clock signals may be used to shift the emission start signal.

The emission driver 140 may generate emission control signals in response to the emission driving control signal. For example, the emission control signals may have the gate-on voltage at which the transistors included in the pixels PXL can be turned on.

The emission driver 140 may be coupled to the emission control lines E1 to En. The emission driver 140 may supply emission control signals to the emission control lines E1 to En. For example, the emission driver 140 may sequentially supply the emission control signals to the emission control lines E1 to En. Alternatively, the emission driver 140 may supply two or more emission control signals simultaneously to the emission control lines E1 to En. Herein, when an emission control signal is supplied, the emission control signal has the gate-on voltage.

The power supply 150 may receive a power supply control signal from the timing controller 160. The power supply 150 may supply voltages to the first voltage line ELVDD, the second voltage line ELVSS, and the third voltage line Vref to the pixel unit 110 in response to the power supply control signal. The power supply 150 may determine a voltage of each of the first voltage line ELVDD, the second voltage line ELVSS, and the third voltage line Vref.

During an emission period in which the pixels PXL emit predetermined light, the first voltage line ELVDD and the second voltage line ELVSS may have a voltage at which a driving current can be generated in the pixels PXL. In some embodiments, the first voltage line ELVDD may have a higher voltage than that of the second voltage ELVSS. Each of the first voltage line ELVDD and the second voltage line ELVSS may have any one of a high-level voltage and a low-level voltage. The third voltage line Vref may have a voltage within a predetermined range. For example, the third voltage line Vref may have a voltage lower than that of the data signal. Alternatively, each of the first voltage line ELVDD, the second voltage line ELVSS, and the third voltage line Vref may have a voltage within a predetermined range.

The timing controller 160 may receive, from a host system, image data and timing signals (e.g., a vertical synchronization signal, a horizontal synchronization signal, a data enable signal, a clock signal, and the like). The timing controller 160 may control the components (e.g., the pixel unit 110, the scan driver 120, the data driver 130, the emission driver 140, and the power supply 150) of the display device 100, based on the image data and the timing signals. For example, the timing controller 160 may transmit the scan driving control signal to the scan driver 120, transmit the data driving control signal to the data driver 130, transmit the emission driving control signal to the emission driver 140, and transmit the power supply control signal to the power supply 150.

Figure 2A:
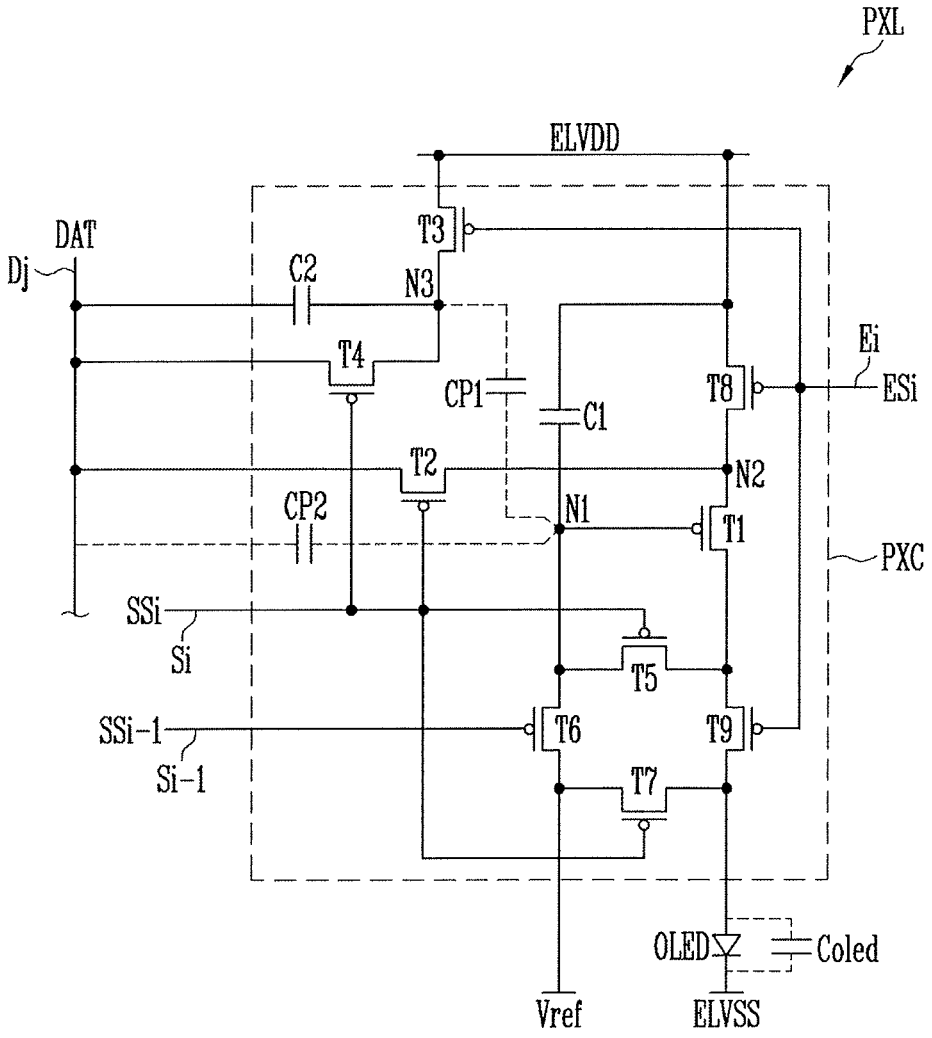
FIGS. 2A to 2C illustrate circuit diagrams of pixels according to embodiments of the present disclosure.

FIG. 2A is a diagram illustrating a pixel PXL according to an embodiment of the present disclosure. For convenience of description, a pixel PXL coupled to an (i-1)th scan line Si-1, an ith scan line Si, an ith emission control line Ei, and a jth data line Dj among the pixels PXL shown in FIG. is representatively illustrated in FIG. 2A.

Referring to FIG. 2A, the pixel PXL may include an organic light emitting diode OLED and a pixel circuit PXC. An anode electrode of the organic light emitting diode OLED may be coupled to the pixel circuit PXC, and a cathode electrode of the organic light emitting diode OLED may be coupled to a second voltage line ELVSS. The organic light emitting diode OLED may generate light with a predetermined luminance corresponding to a driving current supplied from the pixel circuit PXC. The organic light emitting diode OLED may include an emitting layer that emits light, e.g., primary colors, such as red, green, blue light, or white light.

A first voltage line ELVDD may have a voltage higher than the second voltage ELVSS such that a current can flow through the organic light emitting diode OLED. The pixel circuit PXC may control an amount of driving current flowing from the first power line ELVDD to the second voltage line ELVSS via the organic light emitting diode OLED in accordance with a data signal.

The pixel circuit PXC may include a first transistor T1, a second transistor T2, a third transistor T3, a fourth transistor T4, a fifth transistor T5, a sixth transistor T6, a seventh transistor T7, an eighth transistor T8, a ninth transistor T9, a first capacitor C1, and a second capacitor C2. A first node N1 refers to a node commonly coupled to a gate electrode of the first transistor T1, the fifth transistor T5, the sixth transistor T6, and the first capacitor C1. A second node N2 refers to a node commonly coupled to the second transistor T2, the eighth transistor T8, and a first electrode of the first transistor T1. A third node N3 refers to a node commonly coupled to the second capacitor C2, the third transistor T3, and the fourth transistor T4.

The first electrode of the first transistor (driving transistor) T1 may be coupled to the second node N2, and a second electrode of the first transistor T1 may be coupled to the ninth transistor T9. The gate electrode of the first transistor T1 may be coupled to a first node N1.

The second transistor T2 may be coupled between the jth data line Dj and the second node N2. A gate electrode of the second transistor T2 may be coupled to the ith scan line Si. The second transistor T2 may be turned on when an ith scan signal SSi is supplied to the ith scan line Si. When the second transistor T2 is turned on, the jth data line Dj and the second node N2 may be electrically coupled to each other. Therefore, a data signal DAT supplied to the jth data line Dj may be applied to the second node N2.

The third transistor T3 may be coupled between the first voltage line ELVDD and the third node (reference node) N3. A gate electrode of the third transistor T3 may be coupled to the ith emission control line Ei. The third transistor T3 may be turned on when an ith emission control signal ESi is supplied to the ith emission control line Ei. For example, a turn-on period of the third transistor T3 may not overlap with that of the second transistor T2. When the third transistor T3 is turned on, the first voltage line ELVDD and the third node N3 may be electrically coupled to each other. Therefore, the voltage of the first voltage line ELVDD may be applied to the third node N3.

The fourth transistor T4 may be coupled between the jth data line Dj and the third node N3. In addition, a gate electrode of the fourth transistor T4 may be coupled to the ith scan line Si. The fourth transistor T4 may be turned on when the ith scan signal SSi is supplied to the ith scan line Si.

When the fourth transistor T4 is turned on, the jth data line Dj and the third node N3 may be electrically coupled to each other. Therefore, the voltage of the data signal DAT of the jth data line Dj may be applied to the third node N3. The third node N3 may be initialized to the voltage of the data signal DAT. In some embodiments, the third node N3 may be initialized before an emission period of the organic light emitting diode OLED.

The fifth transistor T5 may be coupled between the second electrode of the first transistor T1 and the first node N1. In addition, a gate electrode of the fifth transistor T5 may be coupled to the ith scan line Si. The fifth transistor T5 may be turned on when the ith scan signal SSi is supplied to the ith scan line Si. When the fifth transistor T5 is turned on, the second electrode of the first transistor T1 and the first node N1 may be electrically coupled to each other. Therefore, the first transistor T1 may be diode-coupled.

The sixth transistor T6 may be coupled between the first node N1 and a third voltage line Vref. In addition, a gate electrode of the sixth transistor T6 may be coupled to the (i-1)th scan line Si-1. The sixth transistor T6 may be turned on when an (i-1)th scan signal SSi-1 is supplied to the (i-1)th scan line Si-1. When the sixth transistor T6 is turned on, the first node N1 and the third voltage line Vref may be electrically coupled to each other. Therefore, the voltage of the third voltage line Vref may be applied to the first node N1. The first node N1 may be initialized to the voltage of the third voltage line Vref. Alternatively, the gate electrode of the sixth transistor T6 may be coupled to any one of scan lines S1 to Si-1 that supply scan signals prior to the ith scan line Si.

The seventh transistor T7 may be coupled between the anode electrode of the organic light emitting diode OLED and the third voltage line Vref. In addition, a gate electrode of the seventh transistor T7 may be coupled to the ith scan line Si. The seventh transistor T7 may be turned on when the ith scan signal SSi is supplied to the ith scan line Si.

When the seventh transistor T7 is turned on, the anode electrode of the organic light emitting diode OLED and the third voltage line Vref may be electrically coupled to each other. Therefore, the voltage of the third voltage line Vref may be applied to the anode electrode of the organic light emitting diode OLED. The anode electrode of the organic light emitting diode OLED may be initialized to the voltage of the third voltage line Vref.

The eighth transistor T8 and the ninth transistor T9 may be located on a path of driving current. The eighth transistor T8 may be coupled between the second node N2 and the first voltage line ELVDD. In addition, a gate electrode of the eighth transistor T8 may be coupled to the ith emission control line Ei. The eighth transistor T8 may be turned on when the ith emission control signal ESi is supplied to the ith emission control line Ei.

The ninth transistor T9 may be coupled between the anode electrode of the organic light emitting diode OLED and the second voltage line ELVSS. In addition, a gate electrode of the ninth transistor T9 may be coupled to the ith emission control line Ei. The ninth transistor T8 may be turned on when the ith emission control signal ESi is supplied to the ith emission control line Ei.

The first capacitor C1 may be coupled between the first voltage line ELVDD and the first node N1. The first capacitor C1 may store a voltage corresponding to the data signal and a threshold voltage of the first transistor T1. The second capacitor C2 may be coupled between the jth data line Dj and the third node N3.

As shown in FIG. 2A, a diode parasitic capacitor Coled may be formed between the anode and cathode electrodes of the organic light emitting diode OLED. Charges stored in the diode parasitic capacitor Coled may be initialized when the voltage of the third voltage line Vref is applied to the anode electrode of the organic light emitting diode OLED. Herein, this operation indicates that the anode electrode of the organic light emitting diode OLED is initialized.

In addition, a first parasitic capacitor CP1 may be formed between the first node N1 and the third node N3, and a second parasitic capacitor CP2 may be formed between the first node N1 and the jth data line Dj. Charges stored in the first parasitic capacitor CP1 may be initialized when a constant voltage (e.g., the voltage of the data signal DAT, the voltage of the first voltage line ELVDD, etc.) is applied to the third node N3. Herein, this operation represents that the third node N3 is initialized.

Herein, coupling means that, when a voltage of any one node of a capacitor is changed, a voltage of the other of the nodes of the capacitor is also changed. Coupling may occur between the first node N1 and the third node N3 due to the first parasitic capacitor CP1. Coupling may occur between the first node N1 and the jth data line Dj due to the second parasitic capacitor CP2. Coupling may occur between the third node N3 and the jth data line Dj due to the second parasitic capacitor CP2. Therefore, when the voltage of any one of the jth data line Dj, the first node N1, and the third node N3 is changed, the voltage of at least one of the other two may also be changed.

In some embodiments, at least one of the first transistor T1, the second transistor T2, the third transistor T3, the fourth transistor T4, the fifth transistor T5, the sixth transistor T6, the seventh transistor T7, the eighth transistor T8, and the ninth transistor T9 may be implemented with a P channel Metal Oxide Semiconductor (MOS) transistor. The gate-on voltage of the P channel MOS transistor may be a low-level voltage. Alternatively, at least one of the first transistor T1, the second transistor T2, the third transistor T3, the fourth transistor T4, the fifth transistor T5, the sixth transistor T6, the seventh transistor T7, the eighth transistor T8, and the ninth transistor T9 may be implemented with an N channel MOS transistor. The gate-on voltage of the N channel MOS transistor may be a high-level voltage.

Figure 2B:
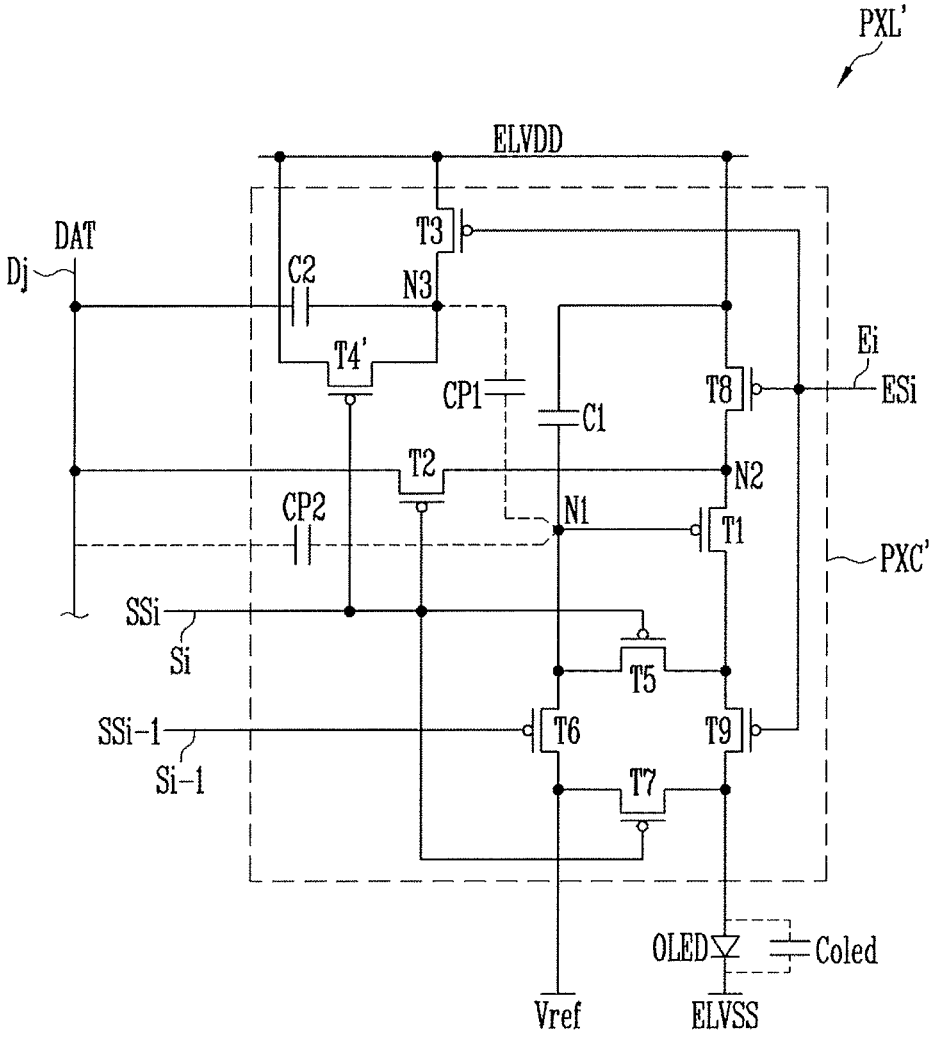

FIG. 2B is a diagram illustrating a pixel PXL' according to another embodiment of the present disclosure. In FIG. 2B, portions different from those of the pixel PXL described in FIG. 2A will be mainly described for clarity. The pixel PXL' shown in FIG. 2B is different from the pixel PXL shown in FIG. 2A in that a fourth transistor T4' is coupled between the first voltage line ELVDD and the third node N3.

That is, a pixel circuit PXC' of the pixel PXL' shown in FIG. 2B may include the first transistor T1, the second transistor T2, the third transistor T3, the fourth transistor T4', the fifth transistor T5, the sixth transistor T6, the seventh transistor T7, the eighth transistor T8, the ninth transistor T9, the first capacitor C1, and the second capacitor C2. The fourth transistor T4' may be coupled between the first voltage line ELVDD and the third node N3, and a gate electrode of the fourth transistor T4' may be coupled to the ith scan line Si. The fourth transistor T4' may be turned on when the ith scan signal SSi is supplied to the ith scan line Si.

When the fourth transistor T4' is turned on, the first voltage line ELVDD and the third node N3 may be electrically coupled to each other. Therefore, the voltage of the first voltage ELVDD may be applied to the third node N3.

Figure 2C:
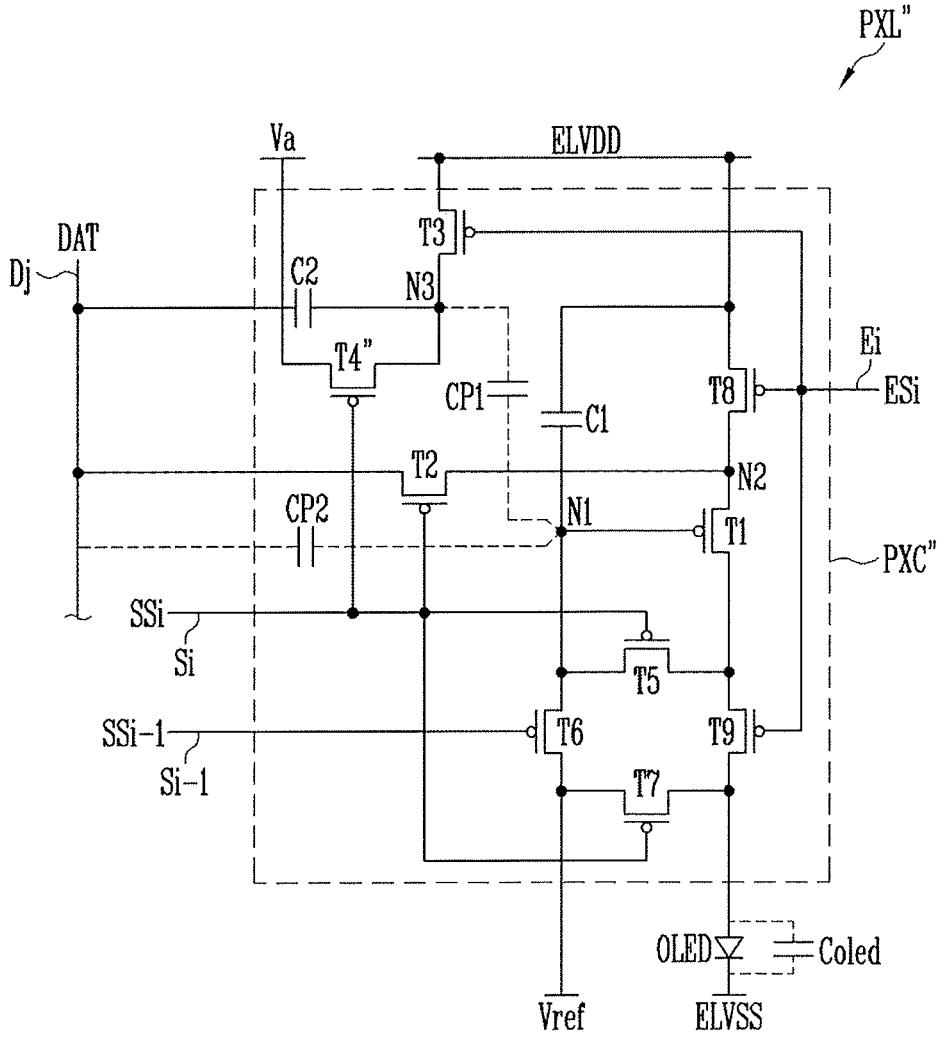

FIG. 2C is a diagram illustrating a pixel PXL" according to another embodiment of the present disclosure. In FIG. 2C, portions different from those of the pixel PXL described in FIG. 2A will be mainly described for clarity. The pixel PXL" shown in FIG. 2C is different from the pixel PXL shown in FIG. 2A in that a fourth transistor T4" is coupled between a fourth voltage line Va and the third node N3.

That is, a pixel circuit PXC" of the pixel PXL" shown in FIG. 2C may include the first transistor T1, the second transistor T2, the third transistor T3, the fourth transistor T4", the fifth transistor T5, the sixth transistor T6, the seventh transistor T7, the eighth transistor T8, the ninth transistor T9, the first capacitor C1, and the second capacitor C2. The fourth transistor T4" may be coupled between the fourth voltage line Va and the third node N3. In addition, a gate electrode of the fourth transistor T4" may be coupled to the ith scan line Si. The fourth transistor T4" may be turned on when the ith scan signal SSi is supplied to the ith scan line Si. For example, the fourth voltage line Va may have a constant voltage within a predetermined range.

When the fourth transistor T4" is turned on, the fourth voltage line Va and the third node N3 may be electrically coupled to each other. The voltage of the fourth voltage Va may be applied to the third node N3.

Figure 3:
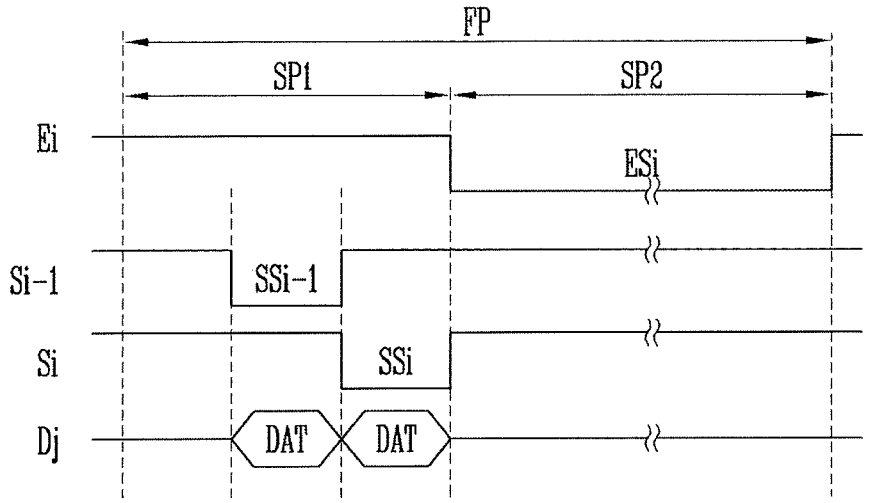
FIG. 3 illustrates a waveform diagram of a driving method of a pixel according to an embodiment of the present disclosure.

FIG. 3 is a waveform diagram illustrating a driving method of the pixel PXL according to an embodiment of the present disclosure. Referring to FIGS. 2A and 3, the pixel PXL may display one image during a frame period FP. The pixels PXL included in the display device 100 may be driven in units of frames. In FIG. 3, a voltage of the ith emission control line Ei, a voltage of the (i-1)th scan line Si-1, a voltage of the ith scan line Si, and a voltage of the data signal DATA during the frame period FP are illustrated.

In FIGS. 2A and 3, an embodiment in which the first to ninth transistors T1 to T9 are implemented with a P channel MOS transistor is representatively described. Therefore, the gate-on voltage is illustrated as a low-level voltage, and a gate-off voltage is illustrated as a high-level voltage.

According to the embodiment of the driving method of the pixel PXL shown in FIG. 3, the frame period FP may include a non-emission period SP1 and an emission period SP2. The non-emission period SP1 and the emission period SP2 may be sequentially performed.

During the non-emission period SP1, the (i-1)th scan signal SSi-1 and the ith scan signal SSi may be sequentially supplied with the gate-on voltage. In addition, the data signal DATA may be supplied in synchronization with scan signal supplied to the scan lines S1 to Sn (see FIG. 1).

First, when the (i-1)th scan signal SSi-1 is supplied, the sixth transistor T6 may be turned on. When the sixth transistor T6 is turned on, the first node N1 may be initialized to the voltage of the third voltage line Vref.

Next, when the ith scan signal SSi is supplied, the second transistor T2, the fourth transistor T4, the fifth transistor T5, and the seventh transistor T7 may be turned on. When the second transistor T2 is turned on, the voltage of the data signal DATA, which is supplied to the jth data line Dj, may be applied to the second node N2. When the fourth transistor T4 is turned on, the voltage of the data signal DATA, which is supplied to the jth data line Dj, may be applied to the third node N3. Therefore, the third node N3 may be initialized to the voltage of the data signal DAT.

Alternatively, as described above in FIG. 2B, when the fourth transistor T4' is turned on, the third node N3 of the pixel PXL' may be initialized to the voltage of the first voltage line ELVDD. Further alternatively, as described above in FIG. 2C, when the fourth transistor T4" is turned on, the third node N3 of the pixel PXL" may be initialized to the voltage of the fourth voltage line Va.

When the fifth transistor T5 is turned on, the first transistor T1 may be diode-coupled. A voltage obtained by subtracting the threshold voltage of the first transistor T1 from the voltage of the data signal DAT may be applied to the first node N1. Therefore, the first capacitor C1 may store a voltage corresponding to the difference between the voltage of the first voltage line ELVDD and the voltage applied to the first node N1. As described above, the threshold voltage of the first transistor T1 can be compensated.

When the seventh transistor T7 is turned on, the voltage of the third voltage line Vref may be applied to the anode electrode of the organic light emitting diode OLED. Therefore, the anode electrode of the organic light emitting diode OLED may be initialized to the voltage of the third voltage line Vref.

During the emission period, the ith emission control signal ESi may be supplied. When the ith emission control signal ESi is supplied, the third transistor T3, the eighth transistor T8, and the ninth transistor T9 may be turned on. When the eighth transistor T8 and the ninth transistor T9 are turned on, the driving current flows via the organic light emitting diode OLED, and the organic light emitting diode OLED may generate predetermined light. Therefore, the pixel PXL may emit light.

When the third transistor T3 is turned on, the voltage of the first voltage line ELVDD may be applied to the third node N3. Therefore, the third node N3 may maintain the voltage of the first voltage line ELVDD.

The driving method of the pixel PXL shown in FIG. 2A, which is described in FIG. 3, may be applied to the pixel PXL' shown in FIG. 2B and the pixel PXL" shown in FIG. 2C. However, the driving method of the pixel PXL' shown in FIG. 2B or the pixel PXL" shown in FIG. 2C are different from the driving method of the pixel PXL shown in FIG. 2A in that, when the fourth transistor T4' or T4" is turned on, the voltage of the first voltage line ELVDD or the voltage of the fourth voltage line Va is applied to the third node N3.

Figure 4:
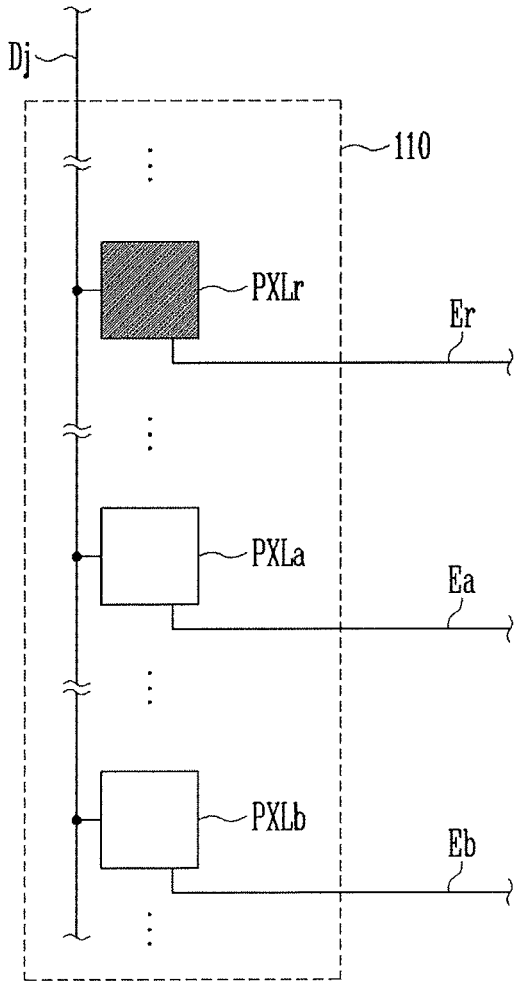
FIG. 4 illustrates a diagram of a driving method of the display device according to an embodiment of the present disclosure.

FIG. 4 is a diagram illustrating a driving method of the display device according to an embodiment of the present disclosure. In FIG. 4, the pixel unit 110 included in the display device, an rth pixel PXLr (r is a natural number), an ath pixel PXLa (a is a natural number larger than r), and a bth pixel PXLb (b is a natural number larger than a) are illustrated for convenience of description. Referring to FIG. 4, the rth pixel PXLr, the ath pixel PXLa, and the bth pixel PXLb may be located on the same pixel column.

Hereinafter, in order to more clearly describe the driving method of the display device of the present disclosure, it is assumed that the rth pixel PXLr is a pixel for emitting light of low brightness (e.g., black) and the ath pixel PXLa and the bth pixel PXLb are pixels for emitting light of high brightness (e.g., white).

The rth pixel PXLr, the ath pixel PXLa, and the bth pixel PXLb may be coupled to a jth data line Dj. The rth pixel PXLr may be coupled to an rth emission control line Er, the ath pixel PXLa may be coupled to an ath emission control line Ea, and the bth pixel PXLb may be coupled to a bth emission control line Eb. Descriptions of the structure and operation of the pixel PXL described in FIGS. 2A (or 2B or 2C) and 3 may be applied to each of the rth pixel PXLr, the ath pixel PXLa, and the bth pixel PXLb.

Figure 5:
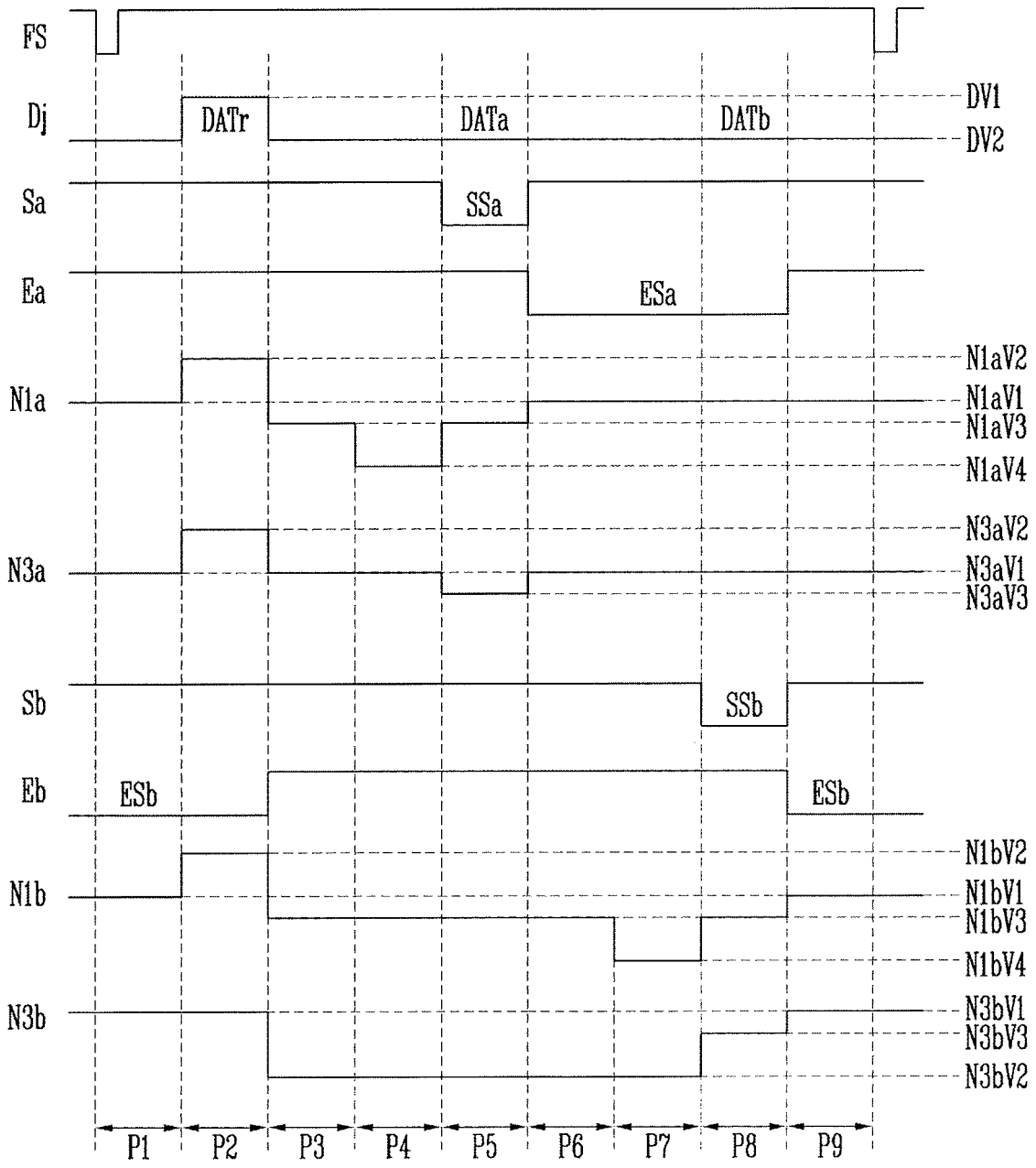
FIG. 5 illustrates a waveform diagram of the driving method shown in FIG. 4.

FIG. 5 is a waveform diagram illustrating the driving method shown in FIG. 4. In FIG. 5, a voltage of a frame signal FS, a voltage of the jth data line Dj, a voltage of an ath scan line Sa, a voltage of the ath emission control line Ea, a voltage of a first node N1*a* (hereinafter, referred to as a 1ath node N1*a*) of the ath pixel PXLa, a voltage of a third node N3*a* (hereinafter, referred to as a 3ath node N3*a*), a voltage of a bth scan line Sb, a voltage of the bth emission control line Eb, a voltage of a first node N1*b* (hereinafter, referred to as a 1bth node N1*b*) of the bth pixel PXLb, and a voltage of a third node N3*b* (hereinafter, referred to as a 3bth node N3*b*) of the bth pixel PXLb are illustrated.

Referring to FIGS. 1 to 5, the frame signal FS may be a signal corresponding to the frame period FP shown in FIG. 3. That is, a period of time from when the frame signal FS is supplied to when the frame signal is again supplied is equal to the frame period FP. A frame of the display device 100 according to the present disclosure may be set for each pixel row. For example, the display device 100 may be driven using a sequential emission method.

When the frame signal FS is supplied, scan signals may be sequentially supplied to the scan lines S1 to Sn, as shown in FIG. 3. Data signals may be supplied in synchronization with the scan signals as shown in FIG. 3.

An rth data signal DATr, an ath data signal DATa, and a bth data signal DATb, which respectively correspond to the rth pixel PXLr, the ath pixel PXLa, and the bth pixel PXLb, may be supplied to the jth data line Dj in synchronization with corresponding scan signals. The rth data signal DATr may have a first data voltage DV1, and the ath data signal DATa and the bth data signal DATb may have a second data voltage DV2. For example, the first data voltage DV1 may be larger than the second data voltage DV2. During a first period P1, the second data voltage DV2 may be supplied to the jth data line Dj, and a bth emission control signal ESb may be supplied to the bth emission control line Eb.

When the bth emission control signal ESb is supplied to the bth emission control line Eb, the 3bth node N3*b* may have a (3b-1)th voltage N3*b*V1. For example, the (3b-1)th voltage N3*b*V1 may be the voltage of the first voltage line ELVDD. That is, during the first period P1, the 3bth node N3*b* may maintain the (3b-1)th voltage N3*b*V1 directly applied thereto, i.e., the voltage of the first voltage line ELVDD. Meanwhile, during the first period P1, the 1ath node N1*a* may have a (1a-1)th voltage N1*a*V1, the 3ath node N3*a* may have a (3a-1)th voltage N3*a*V1, and the 1bth node N1*b* may have a (1b-1)th voltage N1*b*V1.

During a second period P2, the first data voltage DV1 of the rth data signal DATr may be supplied to the jth data line Dj, and the bth emission control signal ESb may be supplied to the bth emission control line Eb. As described in FIG. 3, when the voltage of the jth data line Dj increases from the second data voltage DV2 to the first data voltage DV1, coupling may occur between each of the 1ath node N1*a*, the 3ath node N3*a*, and the 1bth node N1*b*, and the jth data line Dj. When coupling occurs between the 1ath node N1*a* and the jth data line Dj due to the second parasitic capacitor CP2, the voltage of the 1ath node N1*a* may be increased from the (1a-1)th voltage N1*a*V1 to a (1a-2)th voltage N1*a*V2. When coupling occurs between the 3ath node N3*a* and the jth data line Dj due to the capacitor C2, the voltage of the 3ath node N3*a* may be increased from the (3a-1)th voltage N3*a*V1 to a (3a-2)th voltage N3*a*V2. When coupling occurs between the 1bth node N1*b* and the jth data line Dj due to the second parasitic capacitor CP2, the voltage of the 1bth node N1*b* may be increased from the (1b-1)th voltage N1*b*V1 to a (1b-2)th voltage N1*b*V2.

Meanwhile, in the case of the 3bth node N3*b*, the bth emission control signal ESb is supplied to the bth emission control line Eb. Therefore, during the second period P2, the 3bth node N3*b* may maintain the (3b-1)th voltage N3*b*V1 directly applied thereto, i.e., the voltage of the first voltage line ELVDD. For example, the (1a-2)th voltage N1*a*V2 may be larger than the (1a-1)th voltage N1*a*V1, the (3a-2)th voltage N3*a*V2 may be larger than the (3a-1)th voltage N3*a*V1, and the (1b-2)th voltage N1*b*V2 may be larger than the (1b-1)th voltage N1*b*V1.

During a third period P3, the second data voltage DV2 may be supplied to the jth data line Dj. As described in FIG. 3, when the voltage of the jth data line Dj decreases from the first data voltage DV1 to the second data voltage DV2, coupling may occur between each of the 1ath node N1*a*, the 3ath node N3*a*, the 1bth node N1*b*, and the 3bth node N3*b*, and the jth data line Dj. In addition, coupling may occur between the 1ath node N1*a* and the 3ath node N3*a*, and coupling may occur between the 1b node N1*b* and the 3bth node N3*b*.

When coupling occurs between the 1ath node N1*a* and the jth data line Dj, and occurs between the 1ath node N1*a* and the 3ath node N3*a*, the voltage of the 1ath node N1*a* may be decreased from the (1a-2)th voltage N1*a*V2 to a (1a-3)th voltage NaV3. When coupling occurs between the 3ath node N3*a* and the jth data line Dj, and occurs between the 1ath node N1*a* and the 3ath node N3*a*, the voltage of the 3ath node N3*a* may be decreased from the (3a-2)th voltage N3*a*V2 to the (3a-1)th voltage N3*a*V1. When coupling occurs between the 1bth node N1*b* and the jth data line Dj, and occurs between the 1bth node N1*b* and the 3bth node N3*b*, the voltage of the 1bth node N1*b* may be decreased from the (1b-2)th voltage N1*b*V2 to a (1b-3)th voltage N1*b*V3.

When the coupling occurs between the 3bth node N3*b* and the jth data line Dj, and occurs between the 1bth node N1*b* and the 3bth node N3*b*, the voltage of the 3bth node N3*b* may be decreased from the (3b-1)th voltage N3*b*V1 to a (3b-2)th voltage N3*b*V2.

For example, the (1a-3)th voltage N1*a*V3 may be smaller than the (1a-1)th voltage N1*a*V1, the (1b-3)th voltage N1*b*V3 may be smaller than the (1b-1)th voltage N1*b*V1, and the (3b-2)th voltage N3*b*V2 may be smaller than the (3b-1)th voltage N3*b*V1.

During a fourth period P4, the second data voltage DV2 may be supplied to the jth data line Dj, and the 1ath node N1*a* may be initialized to the voltage of the third voltage Vref. The voltage of the third voltage line Vref is directly applied to the 1ath node N1*a*, and therefore, the 1ath node N1*a* may be decreased from the (1a-3)th voltage N1*a*V3 to a (1a-4)th voltage N1*a*V4, i.e., the voltage of the third voltage line Vref.

Meanwhile, during the fourth period P4, the 3ath node N3*a* may have the (3a-1)th voltage N3*a*V1, the 1bth node N1*b* may have the (1b-3)th voltage N1*b*V3, and the 3bth node N3*b* may have the (3b-2)th voltage N3*b*V2. For example, the (1a-4)th voltage N1*a*V4 may be smaller than the (1a-3)th voltage N1*a*V3.

During a fifth period P5, the second data voltage DV2 of the ath data signal DATa may be supplied to the jth data line Dj, and an ath scan signal SSa may be supplied to the ath scan line Sa. As described in FIG. 3, a voltage obtained by compensating for the threshold voltage of the driving transistor in the ath data signal DATa may be applied to the 1ath node N1*a*. For convenience of description, FIG. 5 illustrates that the 1ath node N1*a* has approximately the (1a-3)th voltage N1*a*V3. In addition, when the fourth transistor T4 of the ath pixel PXLa is turned on, the 3ath node N3*a* may be initialized to a (3a-3)th voltage N3*a*V3.

FIG. 5 illustrates that the (3a-3)th voltage N3*a*V3 is less than the (3a-1)th voltage N3*a*V1, the present disclosure is not limited thereto. Alternatively, the (3a-3)th voltage N3*a*V3 may be any one of the voltage of the first voltage line ELVDD, the second data voltage DV2, and the voltage of the fourth voltage line Va. Meanwhile, during the fifth period P5, the 1bth node N1*b* may have the (1b-3)th voltage N1*b*V3, and the 3bth node N3*b* may have the (3b-2)th voltage N3*b*V2.

During a sixth period P6, the second data voltage DV2 may be supplied to the jth data line Dj, and the ath emission control signal ESa may be supplied to the ath emission control line Ea. When the ath emission control signal ESa is supplied to the ath emission control line Ea, the 3ath node N3*a* may have the (3a-1)th voltage N3*a*V1. For example, the (3a-1)th voltage N3*a*V1 may be the voltage of the first voltage ELVDD. That is, during the sixth period P6, the 3ath node N3*a* may maintain the (3a-1)th voltage N3*a*V1 directly applied thereto, i.e., the voltage of the first voltage line ELVDD.

As described in FIG. 3, coupling may occur between the 1ath node N1*a* and the 3ath node N3*a* due to the first parasitic capacitor CP1. When coupling occurs between the 1ath node N1*a* and the 3ath node N3*a*, the voltage of the 1ath node N1*a* may be increased from the (1a-3)th voltage N1*a*V3 to the (1a-1)th voltage N1*a*V1. Meanwhile. during the sixth period P6, the 1bth node N1*b* may have the (1b-3)th voltage N1*b*V3, and the 3bth node N3*b* may have the (3b-2)th voltage N3*b*V2.

During a seventh period P7, the second data voltage DV2 may be supplied to the jth data line Dj, the ath emission control signal ESa may be supplied to the ath emission control line Ea, and the 1bth node N1*b* may be initialized to the voltage of the third voltage Vref. The voltage of the third voltage line Vref is directly applied to the 1bth node N1*b*, and therefore, the 1bth node N1*b* may be decreased from the (1b-3)th voltage N1*b*V3 to a (1b-4)th voltage N1*b*V4, i.e., the voltage of the third voltage line Vref.

In the case of the 3ath node N3*a*, the ath emission control signal ESa is supplied to the ath emission control line Ea. Therefore, during the seventh period P7, the 3ath node N3*a* may maintain the (3a-1)th voltage N3*a*V1 directly applied thereto, i.e., the voltage of the first voltage line ELVDD.

Meanwhile, during the seventh period P7, the 1ath node N1*a* may have the (1a-1)th voltage N1*a*V1, and the 3bth node N3*b* may have the (3b-2)th voltage N3*b*V2. For example, the (1b-4)th voltage N1*b*V4 may be smaller than the (1b-3)th voltage N1*b*V3.

During an eighth period P8, the second data voltage DV2 of the bth data signal DATb may be supplied to the jth data line Dj, the ath emission control signal ESa may be supplied to the ath emission control line Ea, and a bth scan signal SSb may be supplied to the bth scan line Sb. In the case of the 3ath node N3*a*, the ath emission control signal ESa is supplied to the ath emission control line Ea. Therefore, during the eighth period P8, the 3ath node N3*a* may maintain the (3a-1)th voltage N3*a*V1 directly applied thereto, i.e., the voltage of the first voltage line ELVDD.

As described in FIG. 3, a voltage obtained by compensating for the threshold voltage of the driving transistor in the bth data signal DATb may be applied to the 1bth node N1*b*. For convenience of description, FIG. 5 illustrates that the 1b node N1*b* has approximately the (1b-3)th voltage N1*b*V3. In addition, when the fourth transistor T4 of the bth pixel PXLb is turned on, the 3bth node N3*b* may be initialized to a (3b-3)th voltage N3*b*V3.

FIG. 5 illustrates that the (3b-3)th voltage N3*b*V3 is less than the (3b-1)th voltage N3*b*V1. Alternatively, the (3b-3)th voltage N3*b*V3 may be any one of the voltage of the first voltage line ELVDD, the second data voltage DV2, and the voltage of the fourth voltage line Va. Meanwhile, during the eighth period P8, the 1ath node N1*a* may have the (1a-1)th voltage N1*a*V1.

During a ninth period P9, the second data voltage DV2 may be supplied to the jth data line Dj, and the bth emission control signal ESb may be supplied to the bth emission control line Eb. When the bth emission control signal ESb is supplied to the bth emission control line Eb, the 3bth node N3*b* may have the (3b-1)th voltage N3*b*V1. For example, the (3b-1)th voltage N3*b*V1 may be the voltage of the first voltage line ELVDD. That is, during the ninth period P9, the 3bth node N3*b* may maintain the (3b-1)th voltage N3*b*V1 directly applied thereto, i.e., the voltage of the first voltage line ELVDD.

As described in FIG. 3, coupling may occur between the 1bth node N1*b* and the 3bth node N3*b* due to the first parasitic capacitor CP1. When coupling occurs between the 1bth node N1*b* and the 3bth node N3*b*, the voltage of the 1bth node N1*b* may be increased from the (1b-3)th voltage N1*b*V3 to the (1b-1)th voltage N1*b*V1. Meanwhile, during the ninth period P9, the 1ath node N1*a* may have the (1a-1)th voltage N1*a*V1, and the 3ath node N3*a* may have the (3a-1)th voltage N3*a*V1.

In the display device 100 according to the embodiment of the present disclosure, the third node N3 can be initialized to any one of the voltage of the data signal DAT, the voltage of the first voltage line ELVDD, and the voltage of the fourth voltage line Va before the emission period SP2. Accordingly, the display device 100 according to the embodiment of the present disclosure can minimize a difference in coupling (e.g., a change in node voltage) between pixels PXL on a pixel column. Thus, the display device 100 according to the embodiment of the present disclosure can prevent cross-talk during the emission period SP2, and suppress a phenomenon that a ghost image is displayed, thereby improving image quality. As a result, the pixel and the display device including the same can improve image quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A pixel, comprising:

an organic light emitting diode;

a first transistor to control an amount of driving current flowing from a first voltage line connected to a second node to a second voltage line via the organic light emitting diode, corresponding to a voltage of a first node;

a second transistor connected between a data line and the second node, the second transistor having a gate electrode connected to a first scan line;

a third transistor connected between the first voltage line and a third node, the third transistor having a turn-on period that does not overlap with that of the second transistor;

a fourth transistor connected to the third node, the fourth transistor having a gate electrode connected to the first scan line;

a first capacitor connected between the first voltage line and the first node; and a second capacitor connected between the data line and the third node.

2. The pixel as claimed in claim 1, wherein the fourth transistor is connected between the third node and the data line.

3. The pixel as claimed in claim 1, wherein the fourth transistor is connected between the third node and the first voltage line.

4. The pixel as claimed in claim 1, wherein the fourth transistor is connected between the third node and a fourth voltage line.

5. The pixel as claimed in claim 4, wherein the fourth voltage line has a constant voltage within a predetermined range.

6. The pixel as claimed in claim 1, further comprising:

a fifth transistor connected between a second electrode of the first transistor and the first node, the fifth transistor having a gate electrode connected to the first scan line;

a sixth transistor connected between the first node and a third voltage line, the sixth transistor having a gate electrode connected to a second scan line; and a seventh transistor connected between an anode electrode of the organic light emitting diode and the third voltage line, the seventh transistor having a gate electrode connected to the first scan line.

7. The pixel as claimed in claim 6, further comprising:

an eighth transistor connected between the first voltage line and the second node, the eighth transistor having a gate electrode connected to an emission control line; and a ninth transistor connected between the anode electrode of the organic light emitting diode, the ninth transistor having a gate electrode connected to the emission control line.

8. The pixel as claimed in claim 7, wherein the first scan line is an ith (i is a natural number) scan line, and the second scan line is an (i-1)th scan line.

9. The pixel as claimed in claim 1, wherein a gate electrode of the third transistor is connected to an emission control line.

10. The pixel as claimed in claim 1, wherein at least one of the first transistor, the second transistor, the third transistor, and the fourth transistor is a P channel MOS transistor.

11. A display device, comprising:

pixels connected to scan lines, emission control lines, and data lines;

a scan driver to supply scan signals to the pixels through the scan lines;

an emission driver to supply emission control signals to the pixels through the emission control lines; and a data driver to supply data signals to the pixels through the data lines, wherein a pixel connected to an ith (i is a natural number) emission control line, an ith scan line, and a jth (j is a natural number) among the pixels includes:

an organic light emitting diode;

a first transistor to control an amount of driving current flowing from a first voltage line connected to a second node to a second voltage line via the organic light emitting diode, corresponding to a voltage of a first node;

a second transistor connected between the jth data line and the second node, the second transistor having a gate electrode connected to the ith scan line;

a third transistor connected between the first voltage line and a third node, the third transistor having a gate electrode connected to the ith emission control line;

a fourth transistor connected to the third node, the fourth transistor having a gate electrode connected to the ith scan line;

a first capacitor connected between the first voltage line and the first node; and a second capacitor connected between the data line and the third node.

12. The display device as claimed in claim 11, wherein a turn-on period of the second transistor does not overlap with that of the third transistor.

13. The display device as claimed in claim 11, wherein the fourth transistor is connected between the third node and the jth data line.

14. The display device as claimed in claim 11, wherein the fourth transistor is connected to the third node and the first voltage line.

15. The display device as claimed in claim 11, wherein the fourth transistor is connected between the third node and a fourth voltage line.

16. The display device as claimed in claim 15, wherein the fourth voltage line has a constant voltage within a predetermined range.

17. The display device as claimed in claim 11, wherein the scan driver sequentially supplies the scan signals to the pixels.

18. The display device as claimed in claim 11, wherein the emission driver sequentially supplies the emission control signals to the pixels.

* * * * *